US005134287A

United States Patent [19]

Bateman

[11] Patent Number: 5,134,287

[45] Date of Patent: Jul. 28, 1992

[54] DOUBLE-FOCUSSING MASS SPECTROMETER

[75] Inventor: Robert H. Bateman, Knutsford, United Kingdom

[73] Assignee: VG Instruments Group Limited, Haywards Heath, United Kingdom

[21] Appl. No.: 613,583

[22] PCT Filed: Jun. 1, 1989

[86] PCT No.: PCT/GB89/00602

§ 371 Date: Nov. 29, 1990

§ 102(e) Date: Nov. 29, 1990

[87] PCT Pub. No.: WO89/12315

PCT Pub. Date: Dec. 14, 1989

[30] Foreign Application Priority Data

Jun. 1, 1988 [GB] United Kingdom ..... 8812940

[51] Int. Cl.[5] ..... H01J 49/48

[52] U.S. Cl. ..... 250/296; 250/284

[58] Field of Search ..... 250/281, 296, 297

[56] References Cited

U.S. PATENT DOCUMENTS

| | | | |
|---|---|---|---|
| 3,194,961 | 7/1965 | Ewald et al. . | |
| 3,309,517 | 3/1967 | Liot | 250/296 |
| 4,174,479 | 11/1979 | Tuithof et al. | 250/299 |
| 4,435,642 | 3/1984 | Neugebauer et al. | 250/296 |
| 4,480,187 | 10/1984 | Matsuda | 250/299 |
| 4,723,076 | 2/1988 | Bateman | 250/296 |

FOREIGN PATENT DOCUMENTS

| | | | |
|---|---|---|---|
| 425244 | 9/1974 | U.S.S.R. | 250/291 |
| 2216331 | 10/1989 | United Kingdom . | |

OTHER PUBLICATIONS

"A Double-Focusing Toroidal Mass Spectrograph for Energetic Plasmas", Ghielmetti et al., *Nucl. Inst. and Methods in Physics Research*, 1987, pp. 297-303.

Dukhanov, Zelenkov et al., Instrum and Exp Tech 1980, 23 (3) pp. 726-729.

Tuithof, Boerboom and Meuzelaar, Int J Mass Spectrom & Ion Phys, 1975 vol. 17, pp. 299-307.

Tuithof, Boerboom Kistemaker et al., Adv in Mass Spectrometry 1978, vol. 7, pp. 838-845.

Hu, Chen, Boerboom, Matsuda, Int J Mass Spectrom & Ion Proc 1986, vol. 71, pp. 29-36.

Murphy, Mauersberger, Rev Sci Instrum 1985, vol. 56 (2), pp. 220-226.

Boettger, Giffin, Norris, ACS symp ser 102, 1979, pp. 291-318.

Ouwerkerk, Boerboom, Matsuo et al., Int J Mass Spectrom & Ion Proc 1986, vol. 70, pp. 79-96.

Cottrell, Evans, Anal Chem 1987 vol. 59 (15), pp. 1990-1995.

Liebl, Int J. Mass Spectrom & Ion Phys, 1976, vol. 22, pp. 203-207.

Takeshita, Rev Sci Instrum 1967, vol. 38 (10), pp. 1361-1367.

Dymovich, Sysoev, Phys Electron (Moscow) 1965, vol. 2, pp. 15-26.

Dymovich, Dorofeev, Petrov, Phys Electron (Moscow) 1966, vol. 3, p. 66.

*Primary Examiner*—Bruce C. Anderson

*Attorney, Agent, or Firm*—Merchant & Gould Smith, Edell, Welter & Schmidt

[57] ABSTRACT

The invention relates to a variable dispersion double-focusing mass spectrometer comprising at least a magnetic sector analyzer (4) preceding an electrostatic analyzer (6), which analyzers cooperate to form a direction and velocity focused image on a multichannel detector (34) locatable in a focal plane of the electrostatic analyzer (6). The geometrical parameters of the electrostatic analyzer are selected so that the magnification of the electrostatic analyzer is substantially zero, which makes it possible to use a variable radius electrostatic analyzer to vary the extent of the mass spectrum imaged on the detector (34) while still maintaining double focusing. A variable radius electrostatic analyzer suitable for use in the invention is also described.

16 Claims, 4 Drawing Sheets

DOUBLE-FOCUSSING MASS SPECTROMETER

This invention relates to a double focusing mass spectrometer particularly, though not exclusively; with variable dispersion, and is particularly useful in connection with a multi-channel detector.

Most conventional high resolution mass spectrometers are of the Nier-Johnson or Hintenberger-König geometry in which a double (i.e. both direction and velocity) focused image is formed at a narrow collector slit on the ion-optical axis of the last analyzer. In such an instrument a spectrum is obtained by scanning both the electrostatic and magnetic analyzers to successively focus ions of different mass-to-charge ratios on the collector slit. An ion detector, typically an electron multiplier, is disposed beyond the collector slit to receive the ions passing through the slit and produce an electrical signal therefrom.

Although such spectrometers are highly developed and often have high sensitivity and resolution, they are inefficient in so far as only a small proportion of the ions emitted from a sample are detected at any one instant during a scan. The efficiency may be improved by the use of a multichannel detector which is capable of recording a significant part of the spectrum simultaneously. Such detectors typically comprise one or more microchannel plate electron multipliers followed by a phosphor screen and either a photodiode array or vidicon television camera for detecting the position of the electron impacts on the screen. Usually a fibre optic coupling is provided between the phosphor screen and the array or camera.

Multichannel detectors have been fitted to several different kinds of spectrometers. Dukhanvov, Zelenkov et. al (Instrum. and Expt. Techniques, 1980 vol 23(3) pp 726–9), and Tuithof, Boerboom and Meuzelaar (Int. J. Mass Spectrom. and Ion Phys, 1975, vol 17, pp 299–307), describe single focusing magnetic sector instruments fitted with microchannel plate detectors, and Tuithof, Boerboom, Kistemaker and Meuzelaar (Adv. in Mass Spectrom, 1978, vol 7, pp 838–845) describe a more advanced single focusing spectrometer with a channelplate detector and variable mass dispersion. Hu, Chen, Boerboom and Matsuda (Int. J. Mass Spectrom and Ion Proc, 1986, vol. 71 pp 29–36) describe a single focusing spectrometer with an auxiliary magnet for improving performance, and several workers have described Mattauch-Herzog double-focusing instruments with such detectors (e.g., Murphy, Mauersberger Rev. Sci. Instrum., 1985 vol. 56 (2) pp. 220–226; and Boettger, Giffin and Norris, A.C.S. symp. ser. No. 102, 1979, pp 291–318) Ouwerkerk, Boerboom, Matsuo and Sakurai (Int. J. Mass Spectrom and Ion Proc, 1986, vol 70, pp 79–96) and Cottrell and Evans (Anal. Chem. 1987, vol 59(15) pp 1990–1995), report the fitting of multichannel detectors to double focusing mass spectrometers with Nier-Johnson geometry.

Serious limitations on performance arise when multichannel detectors are fitted to spectrometers with geometries designed for scanning. In general, the extent of the spectrum which can be imaged is limited, and resolution is often degraded because of the finite spacing of the individual channels in the channel electron multiplier or the resolution of the photodiode array or television camera. The limitations arise at least in part because the magnification and dispersion of the spectrometer have been selected without regard to the requirements of the multichannel detector. Even on the single-focusing instruments described by Boerboom and coworkers, the need to provide variable dispersion and magnification to gain full benefit from the multichannel detector was recognized in 1978, and the limited performance improvement reported for double focusing instruments which have fixed magnification and dispersion is apparent from the references cited.

In the case of double focusing instruments it is necessary that the velocity focal plane and the direction focal plane (also known as the energy and angular focal planes, respectively) are both coincident and substantially flat over the extent of the detector. These conditions are not necessary for a scanning instrument, where the collector slit is very narrow. They are however characteristic features of Mattauch-Herzog double-focusing spectrometers, but unfortunately most such instruments are designed for photographic plate detection and the focal plane is both very extensive and very close to the poles of the magnet. It is not cost effective to build a multichannel detector which extends over the entire focal plane of such an instrument, and consequently the mass range which can be detected is very limited. The performance of the detector under these conditions is also degraded by the presence of the stray magnetic field. A further disadvantage of the Mattauch-Herzog geometry is that the spacing of the masses along the focal plane is non-linear. In the case of Nier-Johnson geometries, the usable extent of the focal plane is inherently limited by the physical size of the analyzers, and may be further reduced because of curvature. Resolution may also be limited because the dispersion of the spectrometer is not great enough in relation to the channel spacing of the detector. Obviously it is possible to design spectrometers which have adequate dispersion or adequate mass range, but it is impossible to provide both at once on currently available detectors. In practice, there must always be a trade off between resolution and mass range, so that for example, a small part of the spectrum can be simultaneously recorded at high resolution or a much larger part at low resolution, and up to now that choice has to be made when the instrument is designed. In order to maximize the benefit obtainable from a multichannel detector, therefore, it is desirable to have a spectrometer with variable dispersion, similar to that described by Boerboom for a single focusing instrument. However, no such instrument has been described. This is mainly because in all known double focusing geometries, independent variation of the dispersion is impossible without loss of the double focusing conditions, without which resolution cannot be obtained.

It is an object of the present invention to provide a double focusing mass spectrometer having a multichannel detector in which the dispersion can be varied without loss of double focusing and by varying only the parameters associated with one of the analyzer sectors. It is a further object of the invention to provide a double focusing mass spectrometer which has either selectable or continuously variable mass dispersion. It is a yet further object to provide such a spectrometer fitted with a multichannel detector which is capable of recording either a substantial part of the mass range of the spectrometer at low mass resolution or a limited part of the mass range at high resolution while double focusing conditions are maintained.

Viewed from one aspect, the invention provides a mass spectrometer comprising at least a magnetic analyzer and an electrostatic analyzer, through which ions pass in that order, which analyzers cooperate to form a direction and velocity focused image, characterised in that the geometrical parameters of said mass spectrometer are further selected such that the magnification of said electrostatic analyzer is substantially zero.

Viewed from another aspect the invention provides a mass spectrometer comprising at least a magnetic analyzer adapted to receive ions formed from a sample, and an electrostatic analyzer adapted to receive at least some of said ions after they have passed through said magnetic analyzer and to form in cooperation with said magnetic analyzer a direction and velocity focused image therefrom, characterised in that said magnetic analyzer produces a mass dispersed and direction focused ionic image located substantially at infinity.

Viewed from yet another aspect, the invention provides a mass spectrometer comprising at least a magnetic analyzer and an electrostatic analyzer, through which ions pass in that order, which analyzers cooperate to form a direction and velocity focused image, characterised in that the trajectories of ions travelling between said analyzers are substantially parallel.

In any such mass spectrometer it can be shown that the conditions for double focusing (i.e., the production of a direction-focused and velocity-focused image) is independent of factors such as the overall magnification and the distance between the magnetic and electrostatic sectors, in contrast to a conventional double focusing spectrometer with Nier-Johnson or Hintenberger-König geometry. Consequently, the overall magnification (and therefore dispersion at the detector focal plane) of a spectrometer according to the invention can be varied by changing the focal length and image or object distance of one of the analyzers without having to make compensatory adjustments to the dimensions of the other to maintain double focusing.

As explained, a double-focusing spectrometer having easily variable mass dispersion is especially valuable when fitted with a multichannel detector. The invention therefore further provides a mass spectrometer substantially as described, said electrostatic analyzer being constructed to allow its effective radius to be varied, and said spectrometer further comprising at least one multichannel detector locatable in the mass-dispersed image plane of the electrostatic analyzer at whatever value of the effective radius that is selected, whereby portions of the mass spectrum of the ions entering said electrostatic analyzer may be imaged on said detector at different dispersions according to the selected value of said effective radius.

The term "effective radius" is taken to mean the radius of a circular arc which is tangential to the central trajectory of the ions at the points where they enter and leave the electrostatic field, irrespective of the actual shape of the trajectory through the analyzer. It will be appreciated that the position of the multichannel detector will vary with the selected radius of the electrostatic analyzer, and therefore two or more detectors may be provided, one at each of the image planes associated with a particular effective radius. The first of these detectors must obviously be retractable to allow ions to pass to the second detector when required. Alternatively, one detector, translatable between two or more positions, may be provided.

In an alternative embodiment, an electrostatic lens means of variable focal length may be provided between the exit of the electrostatic analyzer and a single multichannel detector. The lens means is adapted to form a focused image on the detector from the intermediate image of the mass spectrum produced at a particular distance from the analyzer by the analyzer at the selected value of the effective radius. By suitable adjustment of the focal length of the lens means, a focused image may be projected onto the detector, irrespective of the position of the image produced by the electrostatic analyzer. In the following, references to locating the detector in the focal plane of the analyzer are meant to include the use of a lens in this way.

In order to obtain full benefit from the invention, an electrostatic analyzer with variable or selectable effective radius is required. Such an analyzer can be constructed in several ways. In one embodiment, the electrostatic analyzer may comprise a plurality of individual analyzer segments, each of different effective radii, in which the effective radius is selected by applying appropriate potentials to any selected one of the segments. Obviously the segments must be such that the ion beam can pass undeflected through them when they are not energized, e.g., by ensuring that the gap between the electrodes of each segment is sufficiently large in relation to their curvature to permit this. It will be appreciated that this arrangement may be double focusing whichever of the individual segments is operational, because in a spectrometer according to the invention the conditions for double focusing are independent of the distance between the magnetic and electrostatic analyzers.

In a more preferred embodiment the electrostatic analyzer may comprise a central segment and one or more pairs of outer segments respectively disposed one on each side of the central segment. The central segment may comprise an analyzer of a first effective radius and each pair of outer segments are arranged in conjunction with the central segment, and any others of the outer segments between its segments and the central segment, to comprise an analyzer with a second effective radius having substantially the same sector angle as the first analyzer. Preferably the outer segments are symmetrically disposed about the central segment.

Each analyzer segment may comprise pairs of cylindrical sector, toroidal sector or straight plate electrodes disposed one on each side of the ion beam in the manner of conventional single-segment analyzers. Most conveniently, each segment may comprise a pair of substantially parallel straight electrodes. All the electrodes on the same side of the ion beam are preferably disposed in the same plane, so that the complete analyzer comprises two parallel straight electrodes disposed one on each side of the ion team with each electrode divided into segments. Typically the electrodes of the central segment will be different lengths, thereby defining a sector angle, and the electrodes comprising an outer segment will be of equal lengths so that an analyzer comprising the central segment and two symmetrically disposed outer segments will have the same sector angle as that comprising only the central segment but a larger effective radius.

Alternatively, especially if a large deflection angle is required, the electrodes of the outer segments may be inclined with respect to the electrodes of the central segment so that the physical disposition of the electrodes resembles a cylindrical sector analyzer in which the electrodes each comprise several straight electrodes of relatively short length.

In further preferred embodiments, at least one of the segments of the analyzer may comprise a pair of main electrodes disposed one on each side of said ion beam and two groups of auxiliary electrodes respectively disposed above and below the beam and spaced apart between the main electrodes. Typically the auxiliary electrodes are the same shape as the main electrodes (e.g. straight plates in the case of a "parallel-plate" segment or circular arcs in the case of a cylindrical sector), and are equally spaced between the main electrodes. The upper and lower groups of electrodes may be substantially identical, comprising the same number, type and spacing of electrodes. Corresponding electrodes in each group may then be electrically connected so that there is no electrical field along an axis perpendicular to the planes of the auxiliary electrodes (i.e., the "z" axis of the analyzer), as in a conventional cylindrical sector analyzer. Each pair of auxiliary electrodes is held at a different potential thereby defining the electrostatic field in the analyzer segment. In the absence of the auxiliary electrodes, the potential between the two parallel straight electrodes would vary linearly with the distance between them, and if the auxiliary electrode potentials are selected to correspond with this variation, their only effect will be to reduce the effect of fringing fields due to the analyzer vacuum housing which might otherwise penetrate between the main electrodes and destroy the field homogeneity. When used in this way the auxiliary electrodes serve a useful purpose in allowing the main electrodes to be separated by a greater distance without trouble from fringing fields, which in turn allows a greater part of the mass spectrum to be simultaneously imaged on a focal plane detector.

Another important use of the auxiliary electrodes is to permit the homogeneity of the field between the main electrodes to be varied simply by adjusting the electrode potentials. For example, the potential between the main electrodes may be set to vary according to the polynomial equation $$V_E = V_M + V_A x_E + V_B x_E^2 + V_C x_E^3 + \ldots$$

wherein $V_E$ is the potential at an auxiliary electrode located at a distance $x_E$ from the central trajectory of the analyzer, $V_M$ is the potential of the central electrode, and $V_A$, $V_B$ and $V_C$ are constants selected as required. In this way, second and third order variations in homogeneity can be introduced into the field between the main electrodes simply by application of appropriate potentials to the auxiliary electrodes, and these variations can be used to optimize focusing of a complete analyzer. Most importantly, the constants $V_A$, $V_B$ and $V_C$ can easily be varied for each segment to optimize the focusing whatever radius is selected. The constants may also be selected to obtain optimum focusing when the complete analyzer is used conventionally for ions of constant energy, or for the analysis of ions of constant velocity, such as fragment ions produced in a collision cell located between the magnetic analyzer and electrostatic analyzer of a complete spectrometer.

The auxiliary electrode pairs may conveniently be supplied from a potential divider network comprising suitably selected resistor values, or may be individually supplied from computer controlled digital-analogue converters if many different sets of coefficients are required.

It will be appreciated that if the auxiliary electrode structure extends sufficiently far from the central trajectory of the analyzer it is possible to omit the main electrodes, and define the electrostatic field within the analyzer segment solely by means of the potentials applied to the auxiliary electrodes. Obviously, omission of the main electrodes will result in severe fringing fields at the ends of the electrode structure, but providing that a sufficient number of electrodes are provided, it may still be possible to define the field in the vicinity of the ion beam sufficiently accurately.

It will also be appreciated that the auxiliary electrodes should be as thin as possible to minimize the length of "constant potential" in the analyzer field in the vicinity of each electrode, and their spacing should be small enough to ensure that the deviation from the ideal potential gradient between the electrodes is not large enough to cause significant aberrations.

The most preferred form of analyzer for use in a spectrometer according to the invention therefore comprises a multi-segment analyzer having parallel straight electrodes, and sets of auxiliary electrodes for each of the segments of the analyzer.

In this way a high resolution double focusing mass spectrometer with multichannel detection and continuously variable or selectable mass dispersion is provided, allowing maximum advantage to be gained from the use of a multichannel detector.

A preferred embodiment of the invention will now be described by reference to the following figures, in which.

Figure 1:
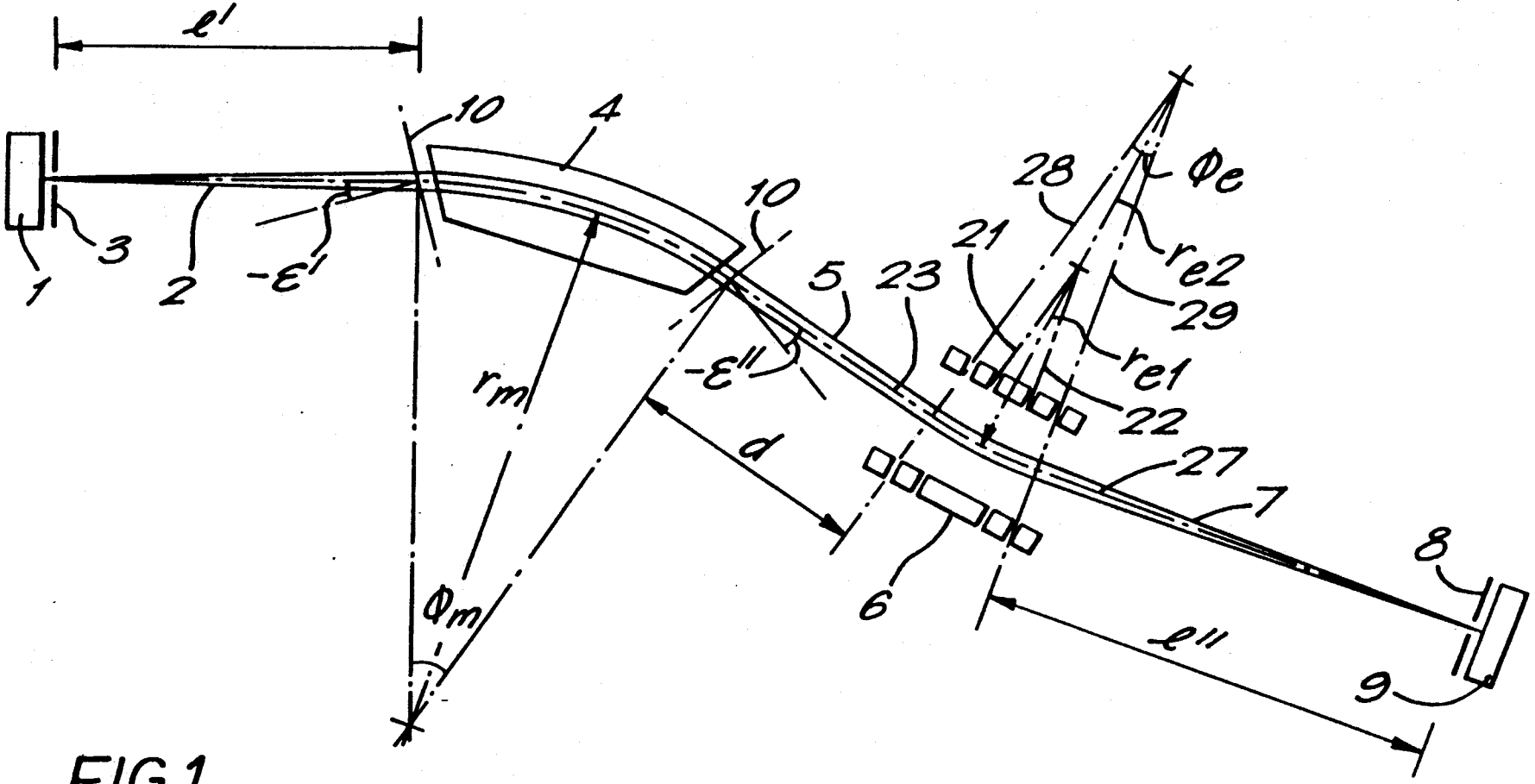
FIG. 1 is a schematic drawing of a spectrometer according to the invention.

Referring first to FIG. 1, an ion source shown schematically at 1 generates an ion beam 2 which passes through a source slit 3. Beam 2 passes through a magnetic sector analyzer 4 comprising a magnet which deflects the ion beam according to the mass-to-charge ratios of the constituent ions. Ions of a selected mass-to-charge ratio leave the magnetic sector analyzer in a substantially parallel beam 5 and enter an electrostatic analyzer 6 which as well as providing energy filtering, focuses the ions into a beam 7 which forms an image at the collector slit 8. An ion detector 9 receives the ions after they have passed through slit 8. Alternatively, a multichannel detector may be provided in the place of the slit 8.

In the following, the conventional system of co-ordinates is used, i.e., x is the direction of motion of the ions, y is the dispersion axis of the analyzers, (perpendicular to x), and z is the axis perpendicular to both x and y.

Defining $y_0$ = positional displacement of an ion leaving source slit 3, $y_0'$ = angular displacement of an ion leaving source slit 3, $y_1$ = positional displacement of an ion entering the first analyzing field (i.e., that due to magnet 4, and $y_1'$ = angular displacement of an ion entering the first analyzing field, then $$y_1 = y_0 + l' y_0' \quad (1)$$

and $$y_1' = y_0' \quad (2)$$

where $l'$ is the distance between the slit 3 and the start of the first analyzing field.

Following conventional procedures, the first order transfer matrix which predicts the position and angular displacements of the ion as it leaves the first analyzing field ($y_2$ and $y_2'$ respectively) is $$\begin{bmatrix} y_2 \\ y_2' \end{bmatrix} = \begin{bmatrix} A_{11} & A_{12} & A_{13} \\ A_{21} & A_{22} & A_{23} \end{bmatrix} \begin{bmatrix} y_1 \\ y_1' \\ \beta \end{bmatrix}$$

in which $\beta$ represents the fractional velocity displacement (i.e., of the ion) and $A_{11}$–$A_{23}$ are matrix elements determined by the geometry of the magnetic field (see below). Consequently, $$Y_2 = A_{11} y_1 + A_{12} y_1' + A_{13}\beta \quad (3)$$

and $$y_2' = A_{21} y_1 + A_{22} y_1' + A_{23}\beta. \quad (4)$$

At the point where ions enter the second analyzing field, typically the electrostatic analyzer 6, the positional and angular displacements ($y_3$ and $y_3'$ respectively) are given by $$y_3 = y_2 + d y_2' \quad (5)$$

and $$y_3' = y_2' (6),$$

where d is the distance between the first and second analyzing fields (see FIG. 1).

At the end of the second analyzing field the positional and angular displacements ($y_4$, $Y_4'$) are given by equations (7) and (8), which are derived from a matrix similar to that for the first analyzing field but incorporating the elements $B_{11}$–$B_{23}$ in place of $A_{11}$–$A_{23}$. Elements $B_{11}$–$B_{23}$ are related to the geometry of the second analyzing field (see below).

$$y_4 = B_{11} y_3 + B_{12} y_3' + B_{13}\beta \quad (7)$$

and $$y_4' = B_{21} y_3 + B_{22} y_3' + B_{23}\beta \quad (8)$$

Finally, at the collector slit 8, the positional and angular displacements are given by $$y_5 = y_4 + l'' y_4' \quad (9)$$

and $$y_5' = y_4' \quad (10)$$

where $l''$ is the distance between the end of the second analyzing field and collector slit 8 (see FIG. 1).

In general terms, the condition for single-focusing is that $y_5 = 0$ when $\beta = 0$ and $y_0' \neq 0$, and the condition for double focusing is that $y_5 = 0$ when $\beta \neq 0$ and $y_0' \neq 0$.

According to a preferred embodiment of the invention, the source slit 3 is positioned such that the trajectories of the ions comprising beam 5 are substantially parallel, so that the image produced by the first analyzing field is located substantially at infinity. In this situation, $y_2'$ must be independent of $y_0'$ when $\beta$ is zero, so that from equations (1) and (4), $$A_{21} l' + A_{22} = 0 \quad (11)$$

and $$y_2' = A_{23}\beta \quad (12).$$

Equation (11) defines a general relationship between the object distance $l'$ and the geometrical parameters of the first analyzing field which should be satisfied for a spectrometer according to the invention to give a first order focus.

Considering next the second analyzing field, preferred embodiments of the invention are such that the second analyzing field receives the parallel beam 5 (i.e., its object is located substantially at infinity) and forms an image at the collector slit 8. At slit 8, $y_5 = 0$, so that from equation (9), $$y_4 + l'' y_4' = 0 \quad (13)$$

From equations (6) and (7), and because when $\beta = 0$, $$y_3' = y_2' = 0,$$

$$y_4 = B_{11} y_3 + B_{12} y_3' = B_{11} y_3 \quad (14)$$

and from equation (8), $$y_4' = B_{21} y_3 + B_{22} y_3' = B_{21} y_3 \quad (15)$$

substituting in equation (13)

$$B_{11} y_3 + l'' B_{21} y_3 = 0$$

so that $$B_{11} + l'' B_{21} = 0 \quad (16)$$

Equation (16) defines the general relationship between the image distance $l''$ and the geometrical parameters of the second analyzing field which should be satisfied for a spectrometer according to the invention to give a first order focus.

Further preferred embodiments of the invention provide spectrometers with double focusing in addition to the single focusing conditions described above. For a spectrometer according to the invention to be double focusing the condition $y_5 = 0$ when $\beta \neq 0$ must also be satisfied.

Assuming $y_1 = 0$ and $y_1' = 0$, then from the previous equations, $$y_1 = 0$$
$$y_1' = 0$$
$$y_2 = A_{13}\beta$$
$$y_2' = A_{23}\beta$$
$$y_3 = (A_{13} + dA_{23})\beta \text{ (from eqn. 5)}$$
$$y_3' = y_2' = A_{23}\beta$$

From (7), $$y_4=(B_{11}(A_{13}+dA_{23})+B_{12}A_{23}+B_{13})\beta$$

and from (8), $$y_4'=(B_{21}(A_{13}+dA_{23})+B_{22}A_{23}+B_{23})\beta.$$

The condition for first order focusing is $$y_5=y_4+1''y_4'=0, \text{ so that}$$

$$y_5 = (B_{11} + 1''B_{21})(A_{13} + dA_{23})\beta + (B_{12} + 1''B_{22})A_{23}\beta + (B_{13} + 1''B_{23})\beta$$

Equation (16) must also be satisfied for first order focusing, i.e., $$(B_{11}+1''B_{21})=0 \tag{16}$$

so that $$y_5 = (B_{12} + 1''B_{22})\,A_{23}\beta + (B_{13} + 1''B_{23})\beta =$$

$$\left[B_{12} - \frac{B_{11}B_{22}}{B_{21}}\right]A_{23}\beta + \left[B_{13} - \frac{B_{11}B_{23}}{B_{21}}\right]\beta = 0$$

Consequently $$\left[B_{12} = \frac{B_{11}B_{22}}{B_{21}}\right]A_{23} + \left[B_{13} - \frac{B_{11}B_{23}}{B_{21}}\right] = 0 \tag{17}$$

Equation (17) defines the relationship between the geometrical parameters of the analyzing fields which should be satisfied for a spectrometer according to the invention to be double focusing. It will be seen that the condition is independent of d so that both the single focusing and double focusing conditions are independent of the distance between the analyzing fields.

Following conventional practice, the coefficients $A_{11}$–$A_{23}$ and $B_{11}$–$B_{23}$ can be written as a set of dimensionless coefficients $a_{11}$–$a_{23}$ and $b_{11}$–$b_{23}$, with, for example, the factor (where present) which scales the coefficient relative to the size of the analyzing field separated out. For example, if the trajectories of the ions through both fields is circular, the coefficients may be written as below:

$$\begin{aligned}
A_{11} &= (y_2/y_3) = a_{11}\\
A_{12} &= (y_2/y_1') = a_{12}\cdot r_a\\
A_{13} &= (y_2/\beta) = a_{13}\cdot r_a\\
A_{21} &= (y_2'/y_1') = a_{21}/r_a\\
A_{22} &= (y_2'/y_1') = a_{22}\\
A_{23} &= (y_2'/\beta) = a_{23}\\
&\text{and}\\
B_{11} &= (y_4/y_3) = b_{11}\\
B_{12} &= (y_4/y_3') = b_{12}\cdot r_b\\
B_{13} &= (y_4/\beta) = b_{13}\cdot r_b\\
B_{21} &= (y_4'/y_3) = b_{21}/r_b\\
B_{22} &= (y_4'/y_3') = b_{22}\\
B_{23} &= (y_4'/\beta) = b_{23}
\end{aligned}$$

where $r_a$ and $r_b$ are the effective radii of the trajectories through the first and second analyzing fields, respectively. (The validity of this representation will be made clearer by consideration of the equations for the various coefficients given below for specific analyzers). If the second analyzing field is a parallel plate electrostatic analyzer, in which the ion trajectory is parabolic rather than circular, then $r_b$ is simply replaced by $l_b$ (the length of the analyzer plates).

Substituting in equation (17)

$$\left[b_{12}r_b - \frac{b_{11}b_{22}r_b}{b_{21}}\right]a_{23} + \left[b_{13}r_b - \frac{b_{11}b_{23}r_b}{b_{21}}\right] = 0$$

so that $$\left[\left[b_{12} - \frac{b_{11}b_{12}}{b_{21}}\right]a_{23} + \left[b_{13} - \frac{b_{11}b_{23}}{b_{21}}\right]\right]r_b = 0$$

Therefore, providing the condition $$\left[b_{12} - \frac{b_{11}b_{22}}{b_{21}}\right]a_{23} + \left[b_{13} - \frac{b_{11}b_{23}}{b_{21}}\right] = 0$$

is met, double focusing occurs irrespective of the values of $r_a$, $r_b$ and d.

Considering next the mass dispersion of a spectrometer according to the invention, the transfer matrix for the first analyzer A can be written $$\begin{bmatrix} y_2 \\ y_2' \end{bmatrix} = \begin{bmatrix} A_{11} & A_{12} & A_{13} & A_{14} \\ A_{21} & A_{22} & A_{23} & A_{24} \end{bmatrix} \begin{bmatrix} y_1 \\ y_1' \\ \beta \\ \gamma \end{bmatrix}$$

in which $\gamma$ is $\Delta m/m$, so that at the exit of the first analyzer, $$y_2=A_{11}y_1+A_{12}y_1'+A_{13}\beta+A_{14}\gamma$$

and $$y_2'=A_{21}y_1+A_{22}y_1'+A_{23}\beta+A_{24}\gamma$$

Assuming as in the previous discussion that $$y_0=y_0'=\beta=y_1=y_1'=0,$$

then $$y_2=A_{14}\gamma \text{ and } y_2'=A_{24}\gamma.$$

At the entrance of the second analyzer $$y_3=y_2+dy_2'=(A_{14}+dA_{24})\gamma$$

and $$y_3'=y_2'=A_{24}\gamma$$

The transfer matrix for the second analyzer B can be written $$\begin{bmatrix} y_4 \\ y_4' \end{bmatrix} = \begin{bmatrix} B_{11} & B_{12} & B_{13} & B_{14} \\ B_{21} & B_{22} & B_{23} & B_{24} \end{bmatrix} \begin{bmatrix} y_3 \\ y_3' \\ \beta \\ \gamma \end{bmatrix}$$

so that $$y_4 = B_{11}(A_{14} + dA_{24})\gamma + B_{12}A_{24}\gamma + B_{14}\gamma$$

and $$y_4' = B_{21}(A_{14} + dA_{24})\gamma + B_{22}A_{24}\gamma + B_{24}\gamma$$

At the collector slit 8

$$y_5 = y_4 + l''y_4',$$

so that $$y_5 = (B_{11} + l''B_{21})(A_{14} + dA_{24})\gamma + (B_{12} + l''B_{22})A_{24}\gamma + (B_{14} + l''B_{24})\gamma \quad (18)$$

Substituting equation (16) in equation (18), $$y_5 = [(B_{12} - B_{11}/B_{22}B_{21})A_{24} + (B_{14} - B_{11}B_{24}/B_{21})]\gamma \quad (19)$$

Replacing the coefficients $B_{11}$–$B_{23}$ in (19) with the dimensionless coefficients listed previously and noting that $a_{24} = A_{24}$ and $b_{24} = B_{24}$, $$y_5 = [(b_{12} - b_{11}b_{22}/b_{21})a_{24} + (b_{14} - b_{11}b_{24}/b_{21})]r_b\gamma \quad (20)$$

From equation (20) it can be seen that in the general case, $y_5$ (effectively the mass dispersion) is related to the radius of the second analyzer $r_b$ and is independent of $r_a$ and d. When the first analyzer is a magnet and the second analyzer is an electrostatic analyzer, then the coefficients $B_{14} = b_{14}r_b = 0$ and $B_{24} = b_{24} = 0$, so that equation (20) simplifies to $$y_5 = (b_{12} - b_{11}b_{22}/b_{21})a_{24}r_b\gamma$$

It is this property of a spectrometer according to the invention that allows a variable dispersion double focusing instrument to be constructed in practice simply by varying the effective radius of the second analyzing field (i.e., the electrostatic analyzer), and adjusting the position of the detector accordingly (equation 16). Clearly, at a particular value of the effective radius of the electrostatic analyzer a particular portion of the mass spectrum is simultaneously imaged on the detector with a particular dispersion and therefore resolution. By changing the effective radius and with it the dispersion, either a large portion of the spectrum can be imaged at low resolution or a smaller portion imaged at high resolution. This maximises the benefit of multichannel detection.

For a magnetic sector homogeneous field analyzer, the values of the coefficients $a_{11}$–$a_{24}$ are related to the geometrical parameters as follows:

$$\begin{aligned}
A_{11} &= \cos(\phi_m - \epsilon')/\cos\epsilon' \\
A_{12} &= r_a\sin\phi_m \\
A_{13} &= r_a(1 - \cos\phi_m) \\
A_{21} &= -\sin(\phi_m - \epsilon' - \epsilon'')/(\cos\epsilon'\cos\epsilon'')r_a \\
A_{22} &= \cos(\phi_m - \epsilon'')/\cos\epsilon'' \\
A_{23} &= \tan\epsilon'' + \sin(\phi - \epsilon'')/\cos\epsilon'' \\
A_{14} &= r_a(1 - \cos\phi_m)/2 \\
A_{24} &= (\tan\epsilon'' + \sin(\phi_m - \epsilon''))/2\cos\epsilon''
\end{aligned}$$

where $\phi_m$, $\epsilon'$ and $\epsilon''$ are the sector angle of the magnetic analyzer and the inclination of its pole faces (see FIG. 1 for the precise definition).

For a cylindrical electrostatic analyzer, the coefficients $b_{11}$–$b_{24}$ are given by $$\begin{aligned}
B_{11} &= \cos(\sqrt{2}\phi_e) \\
B_{12} &= r_b\sin(\sqrt{2}\phi_e)/\sqrt{2} \\
B_{13} &= r_b(1 - \cos(\sqrt{2}\phi_e)) \\
B_{21} &= -\sqrt{2}\sin(\sqrt{2}\phi_e)/r_b \\
B_{22} &= \cos(\sqrt{2}\phi_e) \\
B_{23} &= \sqrt{2}\sin(\sqrt{2}\phi_e) \\
B_{14} &= 0 \\
B_{24} &= 0
\end{aligned}$$

in which $\phi_e$ is the sector angle of the electrostatic analyzer.

For a parallel plate type of electrostatic analyzer, the coefficients $b_{11}$–$b_{24}$ are given by $$\begin{aligned}
B_{11} &= 2\cos\phi_e - 1 \\
B_{12} &= 2r_b\cos\phi_e/(1 + \cos\phi_e) \\
B_{13} &= 2r_b\sin\phi_e/(1 + \cos\phi_e) \\
B_{21} &= -2\sin^2\phi_e/r_b \\
B_{22} &= 2\cos\phi_e - 1 \\
B_{23} &= 2\sin\phi_e \\
B_{14} &= 0 \\
B_{24} &= 0
\end{aligned}$$

Similar expressions for other types of analyzers can be obtained from standard texts on their design. The expressions for these coefficients clearly show how the values of $r_a$ and $r_b$ can be extracted from the coefficients $A_{11}$–$A_{24}$ and $B_{11}$–$B_{24}$ to yield the dimensionless coefficients $a_{11}$–$a_{24}$ and $b_{11}$–$b_{24}$, which depend only on the sector angles $\phi_m$ and $\phi_e$ and the pole face inclinations $\epsilon'$ and $\epsilon''$.

Figure 2:
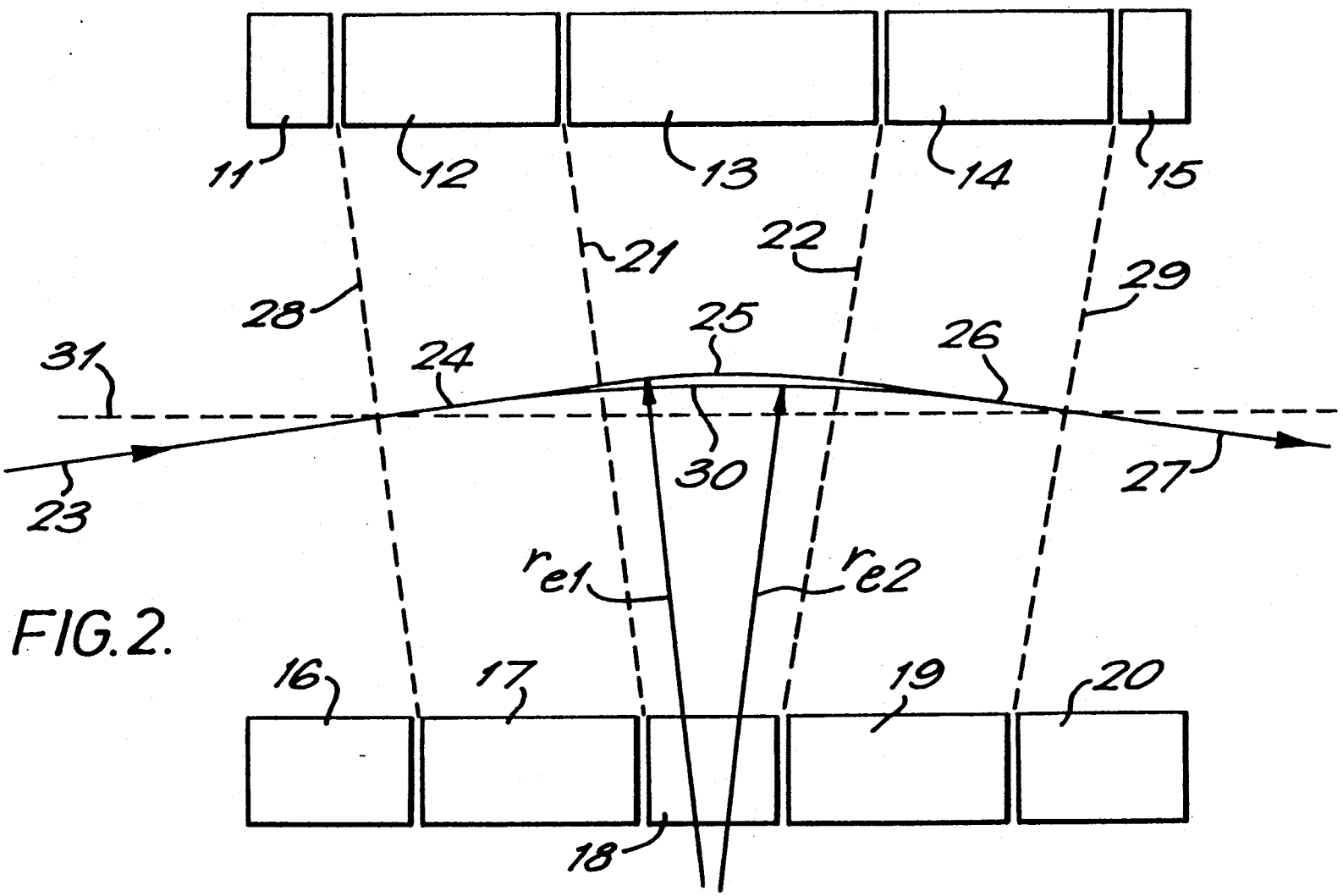
FIG. 2 is a schematic diagram of an electrostatic analyzer suitable for use in the spectrometer of FIG. 1.

Because the double focusing condition is also independent of the distance between analyzers, it is possible to construct a variable radius electrostatic analyzer in the following way. Referring to FIG. 2, an electrostatic sector analyzer suitable for use in the invention comprises a central segment (electrodes 13 and 18), and two pairs of outer segments (electrodes 12, 17, 14, 19 and 11, 16, 15, 20 respectively). The electrodes are disposed symmetrically about a centre line 31, as shown. Electrodes 11, 15, 16 and 20 are generally grounded and used only as guard electrodes. The lengths of the central segment electrodes 13 and 18 are selected to define a parallel plate type analyzer of effective radius $r_e$, and sector angle $\phi_e$ with the field boundaries approximately indicated by lines 21 and 22. When this radius is selected, electrodes 12, 14, 17, and 19 are also grounded and electrodes 13 and 18 are energized with appropriate voltages. Ions travelling along the central trajectory 23 of ion bean 5 therefore continue along a straight trajectory 24 until they enter the electrostatic field at line 21 and then continue along a curved trajectory 25 of effective radius $r_{e1}$. They leave the field at line 22 to continue along the straight trajectory 26 and the central trajectory 27 of ion beam 7.

When radius $r_{e2}$ is selected, the outer segment comprises electrodes 12, 14, 17 and 19. Electrodes 12, 13 and 14 are maintained at a first potential and electrodes 17, 18 and 19 at a second potential, in order to define an electrostatic field bounded approximately by lines 28 and 29 and having a sector angle $\phi_e$ and radius $r_{e2}$. Ions enter along trajectory 23 until line 28 is reached, then continue along curved trajectory 30 (of effective radius $r_{e2}$) until they reach line 29, leaving along trajectory 27 as before. Lines 21 and 28, and 22 and 29, are parallel so that the sector angle $\phi_e$ is the same whichever value of $r_e$ is selected, (this is necessary because the coefficients $b_{11}$–$b_{13}$ are all dependent on $\phi_e$). It will be noted that lines 21 and 28 (which define the start of the field) are spaced apart but this does not matter because the focusing conditions are independent of d, unlike a conventional double focusing spectrometer. Similarly, the electrostatic field terminates in a different place, depending on which radius is selected, but this is easily allowed for in calculating 1".

It will be appreciated that values of $r_e$ intermediate between $r_{e1}$ and $r_{e2}$ can be obtained using an electrostatic analyzer according to FIG. 2 simply by maintaining the outer segment electrodes 12, 14, 17 and 19 at suitable potentials intermediate between ground and those required for operation at radius $r_{e2}$. This situation arises because neither the position of the field boundaries (indicated by lines 28, 21, 22 and 29), nor the actual shape of the trajectory, have any effect on the double focusing properties of a spectrometer according to the invention. Consequently, electrostatic analyzers having more electrodes than shown in FIG. 2 can be constructed, and the easy adjustment of the value of $r_{e1}$ simply by changing electrical potentials can be used to "focus" the mass spectrum exactly at a particular position of the detector.

The practical construction of an electrostatic analyzer according to FIG. 2 presents no difficulty and is in fact less critical in alignment than the conventional electrostatic analyzers currently used in double focusing mass spectrometers.

In a further variation, the electrodes 11–15 and 16–20 may be disposed tangentially around two circular arcs centered on the point from which the effective radii $r_{e1}$ and $r_{e2}$ are measured, thus forming an analyzer which is a hybrid between a cylindrical analyzer and a parallel plate analyzer. Although the exact values of the coefficients $b_{11}$–$b_{23}$ will not be known for such an analyzer, this is of no significance because the value of the radius can easily be changed electrically.

Figure 4:
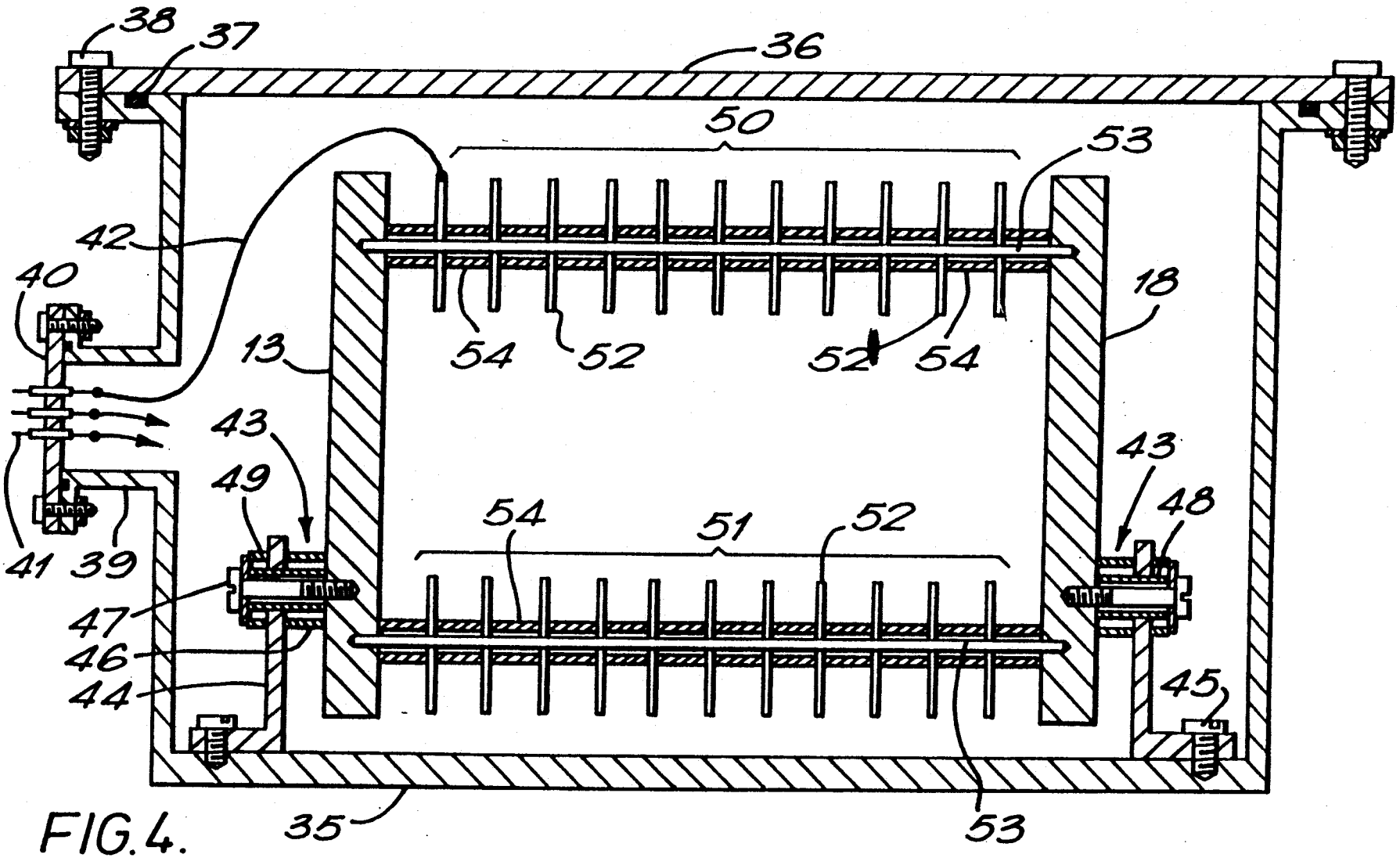
FIG. 4 is a sectional view of an electrostatic analyzer suitable for use in the spectrometer of FIGS. 1 and 3, along the plane A—A shown in FIG. 3.

Referring next to FIG. 4, an electrostatic analyzer suitable for use in the invention is enclosed in a vacuum housing 35 closed by a lid 36 sealed with an 'O' ring 37 and secured by bolts 38. A port 39, closed by an 'O'-ring sealed flange 40 which carries a number of electrical feedthroughs 41, is provided to allow electrical connection to be made to the electrodes comprising the analyzer (e.g., lead 42).

The section shown in FIG. 4 is taken through the central segment of the analyzer (i.e., plane A—A in FIG. 3), but the other segments of the analyzer are of substantially identical construction.

The main electrodes 13 and 18 of the central segment comprise straight plates of length selected to define the required sector angle $\phi_e$ as previously explained.

They are supported on four insulated mountings 43 (two for each electrode) from brackets 44 which are secured to the floor of the vacuum housing 35 with screws 45. Each electrode (13 or 18) is spaced apart from brackets 44 by a ceramic tube 46 and is secured by a screw 47 fitted with a ceramic sleeve 48, and a short ceramic tube 49 is fitted under the head of screw 47 as shown.

An upper group 50 and a lower group 51 of auxiliary electrodes (e.g., 52) are each supported on two ceramic rods 53 which are located in holes drilled in the main electrodes 13 and 18. The auxiliary electrodes 52 are spaced apart by ceramic bushes 54. Each electrode 52 consists of a thin (e.g. 0.5 mm) rectangular metallic plate approximately the same length as the main electrodes. The height of the electrodes should be several, preferably five to ten, times their spacing for the effect of fringing fields to be negligible.

In order to minimize the number of electrical connections to the auxiliary electrodes, corresponding electrodes in the upper group 50 and the lower group 51 are connected together. Similarly, the auxiliary electrodes in the outer segments, also disposed in housing 35, are similarly connected. To further reduce the number of feedthroughs needed, all the auxiliary electrodes associated with the segment comprising main electrodes 12 and 17 are internally connected to the corresponding auxiliary electrodes associated with main electrodes 14 and 19, so that only 11 feedthroughs are required for the auxiliary electrodes of the central segment and a further 11 for all the auxiliary electrodes of the surrounding segments. As explained above, all the electrodes associated with the extreme outer segments (comprising main electrodes 11, 15, 16 and 20) are grounded and require no feedthroughs at all. Thus although the complete analyzer comprising 5 segments has 110 auxiliary electrodes, only 22 feedthroughs are required in total (plus 4 for the main electrodes).

Each of the two sets of auxiliary electrodes (i.e., the central segment and the symmetrical outer segments) are fed from potential divider networks comprising resistors selected to obtain the desired potential gradient between the main electrodes. The potential of the central electrode is of course ground potential (assuming that the entrance slit of the analyzer is also at ground potential, as is conventional), and the two main electrodes 18 and 13 are respectively positive and negative with respect to ground, as they would be in a conventional analyzer. This method of feeding the electrodes is well known. In order to change the potential gradient, the electrodes are simply switched to a different pair of potential dividers.

Several types of multichannel detector are suitable for use in a spectrometer according to the invention, and need not be described in detail. Conveniently, one or more channelplate electron multipliers may be provided, followed by a phosphor screen. Light emitted by the phosphor is transmitted through a coherent fibre optic bundle to a position sensitive photodetector such as an array of photodiodes. Such detectors are well known. Preferably at least one other detector (not multichannel) is provided off axis to the main detector. Ions are deflected into this by means of a deflector electrode, again in a conventional manner.

Figure 3:
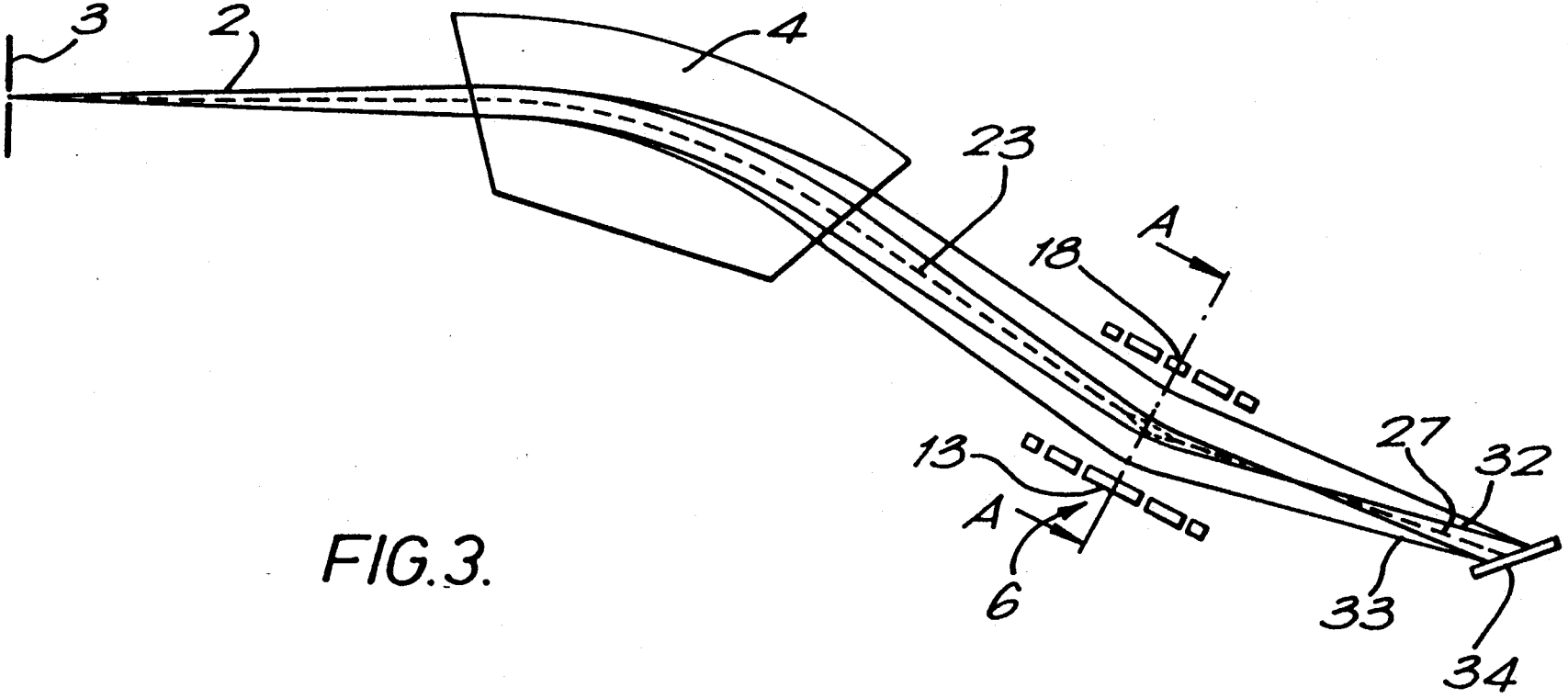
FIG. 3 is a schematic drawing of the spectrometer of FIG. 1 showing the resolution of the ion beam into high and low mass components.

Referring next to FIG. 3, beam 2 comprises ions of two different m/e ratios which are separated by the magnet 4 into two mass resolved beams 32 (high mass ions) and 33 (low mass ions) which are focused at different points on a multichannel detector 34. The detector must be aligned with the focal plane of the spectrometer so that both beams 32 and 33 are focused simultaneously. In general, the focal plane is not at 90° to the axis, in common with conventional spectrometers, but the required angle can be calculated following conventional procedures from the basic focusing equations given earlier. Unfortunately, the inclination of the focal plane varies with different values of $r_e$. This can be allowed for by providing a mechanism to adjust the face of the detector to the correct angle at each selected image distance 1", but as focal plane tilt is effectively a second order aberration it can be substantially eliminated by adjustment of the auxiliary electrode potentials so as to correct the tilt. Similarly, focal plane curvature, a third order aberration, can be corrected by introducing a third order component into the potential gradient as required. It is difficult to directly calculate the values of the electrode potentials required, and the most practical method of selecting them is to use a computer program for "ray tracing" in ion optical systems. By plotting a group of ion trajectories for a given set of electrode potentials the angle and curvature of the focal plane can be estimated, and the most suitable values of potentials chosen by trial and error. Final adjustment of the potentials may then be made on a complete spectrometer, for example by trimming the individual resistor values in the potential divider to maximize resolution across the entire focal plane. In practice, at any selected value of $r_e$, it may be desirable to provide some focal plane rotation by means of the auxiliary electrodes and also to physically rotate the detector rather than rotating the focal plane to the desired position solely by means of the auxiliary electrodes. This may prevent other aberrations becoming too large and reducing the resolution.

Construction of a mechanism for moving a single detector between the various positions corresponding to the selected values of $r_e$ presents no special difficulty.

As an alternative to moving a single detector between several positions, two or more detectors may be provided at the desired locations. Means are also provided for retracting the detectors which are not in use to allow the ion beam to pass to the chosen detector. Retractable detectors are also known in the art.

I claim:

1. A mass spectrometer comprising at least a magnetic analyzer, an electrostatic analyzer, through which ions pass in that order, and ion detector means for detecting at least some of said ions, said magnetic and electrostatic analyzers cooperate to form a direction and velocity focused image, said mass spectrometer having geometrical parameters such that the magnification of said electrostatic analyzer is substantially zero.

2. A mass spectrometer according to claim 1 in which the effective radius of said electrostatic analyzer (6) may be varied, said spectrometer further comprising at least one multichannel detector (34) locatable in the mass dispersed image focal plane of said electrostatic analyzer (6) at whatever value of effective radius that is selected, whereby portions of the mass spectrum of the ions entering said electrostatic analyzer may be imaged on said detector at different dispersions according to the selected value of said effective radius.

3. A mass spectrometer according to claim 1 in which said electrostatic analyzer (6) comprises a plurality of individual analyzer segments (11-20), each of different effective radii, in which the effective radius of said electrostatic analyzer (6) is varied by applying appropriate potentials to the electrodes comprising any selected one of said analyzer segments.

4. A mass spectrometer according to claim 3 in which at least one of said segments comprises two groups (50, 51) of spaced-apart electrodes (52) respectively disposed above and below the beam of ions entering said segment, the potentials of the electrodes comprising each said group progressively increasing from one electrode (52) to the next, thereby providing an electrostatic field in a plane between said groups of electrodes which is capable of deflecting said ions along different curved trajectories according to their energy.

5. A mass spectrometer according to claim 4 in which said groups (50, 51) of electrodes (52) are substantially identical and each electrode in one of said groups is maintained at the same potential as the electrode in a corresponding position in the other of said groups.

6. A mass spectrometer according to claim 4 in which each of the electrodes (52) comprising each group (50, 51) is maintained at a potential $V_E$ given by a polynomial expression of the form $$V_E = V_M + V_A x_E + V_B X_E^2 + V_C X_E^3 + \ldots$$

where $V_E$ is the potential applied to a particular electrode, $V_M$ is the potential of the central electrode, $x_E$ is the distance of that electrode from the central trajectory (positive in one direction, negative in the the other direction), and $V_A$, $V_B$, and $V_C$ are constants.

7. A mass spectrometer according to claim 6 in which the constants $V_A$, $V_B$ and $V_C$ are chosen to reduce second and third order aberrations in the image formed by said electrostatic analyzer (6).

8. A mass spectrometer according to claim 6 further comprising a multichannel detector (34) and in which the constants $V_A$, $V_B$ and $V_C$ are selected to result in alignment of the image focal plane of said electrostatic analyzer with the surface of said detector for at least a substantial portion of the length of said detector, at least at one selected value of said effective radius.

9. A mass spectrometer according to claim 4 in which said electrostatic analyzer (6) can be set to at least two different effective radii, said groups (50, 51) of electrodes (52) are provided for at least three of said segments, and all said electrodes (52) comprised in said groups (50, 51) are maintained at a first set of potentials when one said radius is selected and a second set of potentials when the other said radius is selected, said first and second sets of potentials being respectively selected to optimize the resolution of said spectrometer when said first or said second radius is selected.

10. A mass spectrometer according to claim 3 in which each said segment comprises two substantially parallel, straight main electrodes (13, 18) intersected by and extending on both sides of a plane in which the ions travel, between which electrodes a potential difference is maintained thereby providing in said plane an electrostatic field capable of deflecting said ions along different curved trajectories according to their energy, and in which all said main electrodes on the same side of the beam of ions in said segment are disposed in a common plane.

11. A mass spectrometer according to claim 3 in which at least one of said segments comprises a pair of main electrodes intersected by and extending on both sides of a plane in which the ions travel, between which pair of main electrodes a potential difference is maintained, and two groups of auxiliary electrodes respectively disposed above and below said central plane and spaced apart between said main electrodes.

12. A mass spectrometer according to claim 11 in which said auxiliary electrodes (52) are shaped so that each is spaced a constant distance from said main electrodes.

13. A mass spectrometer according to claim 1 in which said electrostatic analyzer (6) comprises two or more segments through which ions pass in turn and in which at least one of said segments comprises a first analyzer of a first effective radius and at least one other of said segments in conjunction with the segments comprising said first analyzer comprise a second analyzer of a second effective radius.

14. A mass spectrometer according to claim 13 in which said electrostatic analyzer (6) comprises a central segment (13, 18) and one or more pairs of outer segments (12, 14, 17, 19) disposed so that ions travel in turn through one segment of each said outer segment pair, the central segment, and the other segment of each said outer segment pair, in which said central segment comprises an analyzer of a first effective radius and each said pair of outer segments (12, 17 or 14, 19) is arranged in conjunction with said central segment, and any others of said outer segments between its segments and said central segment, to comprise an analyzer of a second effective radius and having substantially the same sector angle as the analyzer comprising said central segment alone.

15. A mass spectrometer comprising at least a magnetic analyzer for receiving ions formed from a sample and to produce therefrom a mass dispersed and direction focused ionic image located substantially at infinity, an electrostatic analyzer for receiving at least some of said ions after they have passed through said magnetic analyzer and to form in cooperation with said magnetic analyzer a direction and velocity focused ionic image therefrom, and ion detector means for detecting at least some of said ions.

16. A mass spectrometer comprising at least a magnetic analyzer, an electrostatic analyzer, through which ions pass in that order, and ion detector means for detecting at least some of said ions, said magnetic and electrostatic analyzers cooperate to form a direction and velocity focused image, in which said ions travelling between said analyzers have trajectories which are substantially parallel to each other.

* * * * *

UNITED STATES PATENT AND TRADEMARK OFFICE

CERTIFICATE OF CORRECTION

PATENT NO. : 5,134,287

DATED : July 28, 1992

INVENTOR(S) : Robert H. Bateman

It is certified that error appears in the above-identified patent and that said Letters Patent is hereby corrected as shown below:

In [30] delete "8812940" and insert --8812940.8-- therefor.

In the Abstract, delete "a" and insert --the-- therefor.

In [54], delete "DOUBLE-FOCUSSING" and insert --DOUBLE-FOCUSING-- therefor.

In column 1, title, delete "DOUBLE-FOCUSSING" and insert --DOUBLE-FOCUSING-- therefor.

In column 1, line 5, delete "particularly, though not exclusively;" after the word "spectrometer".

In column 3, lines 3, 4, delete "characterised in that" after the word "image".

In column 3, line 5, delete "are" and insert --being-- therefor.

In column 3, line 9, after the word "and", insert --to produce therefrom a mass dispersed and direction focused ionic image located substantially at infinity, and--.

In column 3, line 14, delete "," and insert --.-- therefor.

UNITED STATES PATENT AND TRADEMARK OFFICE

CERTIFICATE OF CORRECTION

PATENT NO. : 5,134,287

DATED : July 28, 1992

INVENTOR(S) : Robert H. Bateman

It is certified that error appears in the above-identified patent and that said Letters Patent is hereby corrected as shown below:

In column 3, lines 14, 15 and 16, delete "characterised in that said magnetic analyzer produces a mass dispersed and direction focused ionic image located substantially at infinity" after the word "therefrom".

In column 3, line 22, delete "characterised in that" and insert --in which-- therefor.

In column 4, line 53, delete "team" and insert --beam-- therefor.

In column 5, line 40, delete "$V_m + V_a \times E + V_B \times E^2 + V_{Cx\ E3} + \ldots$" and insert --$V_A\ (1 + ax_E + bx_E^2 + cx^3_E + \ldots)$-- therefor.

In column 5, line 42, delete "wherein" and insert --where-- therefor.

In column 5, line 44, delete "$V_M$" and insert --$V_A$-- therefor.

In column 5, lines 45, 51 and 52, delete "$V_A$, $V_B$ and $V_C$" and insert --a, b, and c-- therefor.

In column 7, line 1, delete "1' yo'" and insert --$1'Y_o$-- therefor.

In column 7, line 40, "(6)" should be moved to the end of the line.

UNITED STATES PATENT AND TRADEMARK OFFICE

CERTIFICATE OF CORRECTION

PATENT NO. : 5,134,287

DATED : July 28, 1992

INVENTOR(S) : Robert H. Bateman

It is certified that error appears in the above-identified patent and that said Letters Patent is hereby corrected as shown below:

In column 10, line 11, delete "$b_{11}b_{12}$" and insert --$b_{11}$ $b_{22}$-- therefor.

In column 11, line 20, delete "$B_{11}/B_{22}B_{21}$) and insert --$B_{11}$ $B_{22}$/ $B_{21}$ )-- therefor.

In column 16, line 8, delete "$V_M + V_A x_E + V_B X_E2_3 + V_C X_E3 + . . .$" and insert --$V_A(1 + ax_E-+bx_E^2+ cx_E^3+ . . . )$-- therefor.

In column 16, line 11, delete "$V_M$" and insert --$V_A$ -- therefor.

In column 16, line 14, delete "$V_A$, $V_B$ and $V_C$" and insert --a, b and c-- therefor.

In column 16, line 16, delete "$V_A$, $V_B$ and $V_C$" and insert --a, b and c-- therefor.

UNITED STATES PATENT AND TRADEMARK OFFICE

CERTIFICATE OF CORRECTION

PATENT NO. : 5,134,287

DATED : July 28, 1992

INVENTOR(S) : Robert H. Bateman

It is certified that error appears in the above-indentified patent and that said Letters Patent is hereby corrected as shown below:

In column 16, line 21, delete "$V_A$, $V_B$ and $V_C$" and insert --a, b and c-- therefor.

Signed and Sealed this

Thirtieth Day of May, 1995

Bruce Lehman

BRUCE LEHMAN

*Commissioner of Patents and Trademarks*

*Attest:*

*Attesting Officer*

UNITED STATES PATENT AND TRADEMARK OFFICE

CERTIFICATE OF CORRECTION

PATENT NO. : 5,134,287

DATED : July 28, 1992

INVENTOR(S) : Robert H. Bateman

It is certified that error appears in the above-identified patent and that said Letters Patent is hereby corrected as shown below:

In the Abstract, delete "a" and insert --the-- therefor.

In [54], delete "DOUBLE-FOCUSSING" and insert --DOUBLE-FOCUSING-- therefor.

In column 1, title, delete "DOUBLE-FOCUSSING" and insert --DOUBLE-FOCUSING-- therefor.

In column 1, line 5, delete "particularly, though not exclusively;" after the word "spectrometer".

In column 3, lines 3, 4, delete "characterised in that" after the word "image".

In column 3, line 5, delete "are" and insert --being-- therefor.

In column 3, line 9, after the word "and", insert --to produce therefrom a mass dispersed and direction focused ionic image located substantially at infinity, and--.

In column 3, line 14, delete "," and insert --.-- therefor.

UNITED STATES PATENT AND TRADEMARK OFFICE

CERTIFICATE OF CORRECTION

PATENT NO. : 5,134,287

DATED : July 28, 1992

INVENTOR(S) : Robert H. Bateman

It is certified that error appears in the above-identified patent and that said Letters Patent is hereby corrected as shown below:

In column 3, lines 14, 15 and 16, delete "characterised in that said magnetic analyzer produces a mass dispersed and direction focused ionic image located substantially at infinity" after the word "therefrom".

In column 3, line 22, delete "characterised in that" and insert --in which-- therefor.

In column 4, line 53, delete "team" and insert --beam-- therefor.

In column 5, line 40, delete "$V_m + V_a \times E + V_B \times E^2 + V_{Cx\,E3} + \ldots$" and insert --$V_A\ (1 + ax_E + bx_E^2 + cx^3_E + \ldots)$-- therefor.

In column 5, line 42, delete "wherein" and insert --where-- therefor.

In column 5, line 44, delete "$V_M$" and insert --$V_A$-- therefor.

In column 5, lines 45, 51 and 52, delete "$V_A$, $V_B$ and $V_C$" and insert --a, b, and c-- therefor.

In column 7, line 1, delete "1' yo'" and insert --$1'Y_o$-- therefor.

In column 7, line 40, "(6)" should be moved to the end of the line.

UNITED STATES PATENT AND TRADEMARK OFFICE

CERTIFICATE OF CORRECTION

PATENT NO. : 5,134,287

DATED : July 28, 1992

INVENTOR(S) : Robert H. Bateman

It is certified that error appears in the above-identified patent and that said Letters Patent is hereby corrected as shown below:

In column 10, line 11, delete "$b_{11}b_{12}$" and insert --$b_{11}$ $b_{22}$-- therefor.

In column 11, line 20, delete "$B_{11}/B_{22}B_{21}$) and insert --$B_{11}$ $B_{22}$/ $B_{21}$ )-- therefor.

In column 16, line 8, delete "$V_M + V_A x_E + V_B X_E2 + V_C X_E3 + . . .$" and insert --$V_A(1 + ax_E - + bx_E^2 + cx_E^3 + . . . )$-- therefor.

In column 16, line 11, delete "$V_M$" and insert --$V_A$ -- therefor.

In column 16, line 14, delete "$V_A$, $V_B$ and $V_C$" and insert --a, b and c-- therefor.

In column 16, line 16, delete "$V_A$, $V_B$ and $V_C$" and insert --a, b and c-- therefor.

UNITED STATES PATENT AND TRADEMARK OFFICE

CERTIFICATE OF CORRECTION

PATENT NO. : 5,134,287

DATED : July 28, 1992

INVENTOR(S) : Robert H. Bateman

It is certified that error appears in the above-indentified patent and that said Letters Patent is hereby corrected as shown below:

In column 16, line 21, delete "$V_A$, $V_B$ and $V_C$" and insert --a, b and c-- therefor.

This certificate supersecedes Certificate of Correction issued May 13, 1995.

Signed and Sealed this

Second Day of January, 1996

Bruce Lehman

BRUCE LEHMAN

*Commissioner of Patents and Trademarks*

*Attest:*

*Attesting Officer*